US006354209B1

(12) United States Patent
Van Aert et al.

(10) Patent No.: US 6,354,209 B1
(45) Date of Patent: Mar. 12, 2002

(54) METHOD FOR MAKING POSITIVE WORKING PRINTING PLATES FROM A LATEX

(75) Inventors: Huub Van Aert, Mortsel; Leo Oelbrandt, Kruibeke, both of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/342,103

(22) Filed: Jun. 29, 1999

(30) Foreign Application Priority Data

Jul. 31, 1998 (EP) ..... 98202577

(51) Int. Cl.[7] ..... B41C 1/10

(52) U.S. Cl. ..... 101/466; 101/457; 101/462; 347/96

(58) Field of Search ..... 101/453, 454, 101/457, 462, 463.1, 465, 466; 347/95, 96, 102

(56) References Cited

U.S. PATENT DOCUMENTS 4,694,302 A * 9/1987 Hackleman et al. ..... 347/96
5,312,654 A * 5/1994 Arimatsu et al. ..... 347/95
5,429,860 A * 7/1995 Held et al. ..... 347/96
5,466,653 A 11/1995 Sheau-Hwa et al. ..... 503/200
5,568,173 A * 10/1996 Leenders et al. ..... 347/96
5,695,908 A * 12/1997 Furukawa ..... 101/466
5,738,013 A * 4/1998 Kellett ..... 101/463.1
5,820,932 A 10/1998 Hallman et al. ..... 101/465
6,025,022 A * 2/2000 Matzinger ..... 101/463.1
6,033,740 A * 3/2000 Oelbrandt et al. ..... 101/465
6,050,193 A * 4/2000 DeBoer et al. ..... 101/466

OTHER PUBLICATIONS

Patent Abstracts of Japan, vol. 016, No. 278 (M–1268), Jun. 22, 1992 and JP 04 069245 A (Konica Corp.), Mar. 4, 1992.

* cited by examiner

*Primary Examiner*—Stephen R. Funk
(74) *Attorney, Agent, or Firm*—Breiner & Breiner, L.L.C.

(57) ABSTRACT

According to the present invention there is provided a method for making a lithographic printing plate including the steps of dispensing in a predetermined pattern a latex of particles of a hydrophobic polymer onto an optionally modified hydrophilic surface of a lithographic base, characterized in that the hydrophobic polymer and the optionally modified hydrophilic surface of the lithographic base have mutually reactive groups.

7 Claims, No Drawings

METHOD FOR MAKING POSITIVE WORKING PRINTING PLATES FROM A LATEX

This application is based on provisional application Ser. No. 60/101,035 filed Sep. 18, 1998.

FIELD OF THE INVENTION

The present invention relates to methods for making lithographic printing plates. In particular, it relates to a method for directly making the lithographic printing plates by using hydrophobic polymer latex printing, which makes it possible to produce the lithographic plates directly from digital data output from computers, facsimiles, or the like without using any intermediate films.

BACKGROUND OF THE INVENTION.

Digitalization of information has made a rapid progress in recent years throughout the process from manufacturing a block copy, an upper stream process of printing, to manufacturing a printing plate, thereby putting to practical use for example, a photographic form system of characters, by which a block copy of manuscripts can be readily prepared, or a scanner which directly reads picture images. With this progress, there has arisen a demand for a direct plate-making method in which lithographic plates can be directly prepared from digital data output from computers, facsimiles, or the like without using a film for making printing plates.

As one example of the direct plate-making method, a method wherein an image or non-image portion is directly formed on a substrate by ink-jet printing is known to the art. The ink-jet printing system is a relatively rapid image output system and has a simple construction because it does not require any complex optical system. Therefore, the printing system makes an apparatus for making printing plates simple and the cost for making printing plates can be reduced since the maintenance labor is largely reduced.

As examples of the methods for preparing printing plates by using the ink-jet printing system, Japanese Kokai Publication 113456/1981 proposes the methods for preparing printing plates wherein ink-repelling materials (e.g. curable silicone) are printed on a printing plate by ink-jet printing. The printing plate obtained by this method is an intaglio printing plate in which the ink-repelling material formed on the surface of the substrate serves as a non-image part. As a result, the resolution of the printed images at shadow area or reversed lines is not so good. Moreover, a large amount of ink is needed in this method because the ink-repelling material must be deposited on the whole non-image part which occupies most of the surface of the printing plate.

U.S. Pat. No. 5,312,654 discloses a method for making lithographic printing plates comprising: forming an image on a substrate having an ink absorbing layer and a hydrophilized layer between the substrate and absorbing layer by ink-jet printing using a photopolymerizable ink composition, and exposing it to an active light in the wavelength region curing the image. The printing endurance of said printing plates is low.

EP-A- 533 168 discloses a method for avoiding ink spreading by coating the lithographic base with an ink absorbing layer which is removed after ink printing. This is an uneconomical and cumbersome method.

Research Disclosure 289118 of May 1988 discloses a method for making printing plates with the use of an ink jet wherein the ink is a hydrophobic polymer latex. However said printing plates have a poor ink acceptance and a low printing endurance.

OBJECTS OF THE INVENTION

It is an object of the invention to provide a method for making lithographic printing plates from a lithographic base having a hydrophilic surface image-wise imaged with a hydrophobic polymer latex which yields an excellent lithographic printing plate with a high printing endurance.

It is further an object of the present invention to provide a method for making lithographic printing plates without a wet development of the lithographic base in a rapid , economical and ecological way.

Further objects of the present invention will become clear from the description hereinafter.

SUMMARY OF THE INVENTION

According to the present invention there is provided a method for making a lithographic printing plate comprising the steps of dispensing in a predetermined pattern a latex of particles of a hydrophobic polymer onto an optionally modified hydrophilic surface of a lithographic base, characterized in that said hydrophobic polymer and the optionally modified hydrophilic surface of the lithographic base have mutually reactive groups.

DETAILED DESCRIPTION OF THE INVENTION

According to the present invention, the lithographic base may be an anodized aluminum support. A particularly preferred lithographic base is an electrochemically grained and anodized aluminum support. The anodized aluminum support may be treated to improve the hydrophilic properties of its surface. For example, the aluminum support may be silicated by treating its surface with sodium silicate solution at elevated temperature, e.g. 95° C. Alternatively, a phosphate treatment may be applied which involves treating the aluminum oxide surface with a phosphate solution that may further contain an inorganic fluoride. Further, the aluminum oxide surface may be rinsed with a citric acid or citrate solution. This treatment may be carried out at room temperature or may be carried out at a slightly elevated temperature of about 30 to 50° C. A further interesting treatment involves rinsing the aluminum oxide surface with a bicarbonate solution. Still further, the aluminum oxide surface may be treated with polyvinylphosphonic acid, polyvinylmethylphosphonic acid, phosphoric acid esters of polyvinyl alcohol, polyvinylsulphonic acid, polyvinylbenzenesulphonic acid, sulphuric acid esters of polyvinyl alcohol, and acetals of polyvinyl alcohols formed by reaction with a sulphonated aliphatic aldehyde. It is further evident that one or more of these post treatments may be carried out alone or in combination. More detailed descriptions of these treatments are given in GB-A- 1 084 070, DE-A- 4 423 140, DE-A- 4 417 907, EP-A- 659 909, EP-A- 537 633, DE-A- 4 001 466, EP-A- 292 801, EP-A- 291 760 and U.S. PAT. No. 4,458,005.

According to another mode in connection with the present invention, the lithographic base with an optionally modified hydrophilic surface comprises a flexible support, such as e.g. paper or plastic film, provided with a cross-linked optionally modified hydrophilic layer. A particularly suitable cross-linked hydrophilic layer may be obtained from a hydrophilic binder cross-linked with a cross-linking agent such as a melamine-resin, formaldehyde, dialdehydes like glutaric dialdehyde glyoxal, polyisocyanate or a hydrolyzed tetraalkylorthosilicate. The latter is particularly preferred.

As hydrophilic binder there may be used hydrophilic (co)polymers such as for example, homopolymers and copolymers of vinyl alcohol with as reactive functions hydroxyl groups, acrylamide with as reactive function an amide group, methylol acrylamide, methylol methacrylamide, acrylic acid, methacrylic acid, hydroxyethyl acrylate, hydroxyethyl methacrylate, all with a hydroxyl function as reactive group, maleic anhydride with an anhydride as reactive group, maleic acid with a hydroxyl function as reactive group, maleic anhydride/vinylmethylether copolymers anhydride with an anhydride as reactive group. The hydrophilic binder can partially contain crosslinkable or reactive groups e.g. silanol modified polyvinylalcohol, vinylalcohol copolymer with crosslinkable acrylamides like N-(-methoxymethyl)-acrylamide, n-butoxymethyl acrylamide, n-butoxymethyl methacrylamide. The hydrophilicity of the (co)polymer or (co)polymer mixture used is preferably the same as or higher than the hydrophilicity of polyvinyl acetate hydrolyzed to an extent of at least 60 percent by weight, preferably at least 80 percent by weight.

The amount of crosslinking agent, in particular of tetraalkyl orthosilicate, is preferably at least 0.2 parts by weight per part by weight of hydrophilic binder, more preferably between 0.5 and 5 parts by weight, most preferably between 1.0 parts by weight and 3 parts by weight. The amount of cross-linking agent is not so high that no hydroxyl groups of the polyvinyl alcohol remain.

A cross-linked hydrophilic layer in a lithographic base used in accordance with the present embodiment preferably also contains substances that increase the mechanical strength and the porosity of the layer. For this purpose colloidal silica may be used. The colloidal silica employed may be in the form of any commercially available water-dispersion of colloidal silica for example having an average particle size up to 40 nm, e.g. 20 nm. In addition inert particles of larger size than the colloidal silica may be added e.g. silica prepared according to Stober as described in J. Colloid and Interface Sci., Vol. 26, 1968, pages 62 to 69 or alumina particles or particles having an average diameter of at least 100 nm which are particles of titanium dioxide or other heavy metal oxides. By incorporating these particles the surface of the cross-linked hydrophilic layer is given a uniform rough texture consisting of microscopic hills and valleys, which serve as storage places for water in background areas.

In a particular embodiment, the lithographic base comprises a hydrophilic binder which comprises reactive groups selected from the group consisting of epoxides, alkoxysilanes and reactive acrylamides which can react with hydroxyl, amino or amido functions of the hydrophobic polymer.

The thickness of a cross-linked hydrophilic layer in a lithographic base in accordance with this embodiment may vary in the range of 0.2 to 25 $\mu$m and is preferably 1 to 10 $\mu$m.

Particular examples of suitable cross-linked hydrophilic layers for use in accordance with the present invention are disclosed in EP-A- 601 240, GB-P- 1 419 512, FR-P- 2 300 354, U.S. Pat. Nos. 3,971,660, 4,284,705 and EP-A- 514 490.

As flexible support of a lithographic base in connection with the present embodiment it is particularly preferred to use a plastic film e.g. substrated polyethylene terephthalate film, substrated polyethylene naphthalate film, cellulose acetate film, polystyrene film, polycarbonate film etc . . . The plastic film support may be opaque or transparent. Also suitable as flexible support is glass with a thickness less than 1.2 mm and a failure stress (under tensile stress) equal or higher than $5\times10^7$ Pa.

It is particularly preferred to use a polyester film support to which an adhesion improving layer has been provided. Particularly suitable adhesion improving layers for use in accordance with the present invention comprise a hydrophilic binder and colloidal silica as disclosed in EP-A- 619 524, EP-A- 620 502 and EP-A- 619 525. Preferably, the amount of silica in the adhesion improving layer is between 200 mg per $m^2$ and 750 mg per $m^2$. Further, the ratio of silica to hydrophilic binder is preferably more than 1 and the surface area of the colloidal silica is preferably at least 300 $m^2$ per gram, more preferably at least 500 $m^2$ per gram.

A latex is defined as a stable colloidal dispersion of a polymeric substance in an aqueous medium. The polymer particles are usually approximately spherical and of typical colloidal dimensions: particle diameters range from about 20 to 1000 nm. The dispersion medium is usually a dilute aqueous solution containing substances such as electrolytes, surfactants, hydrophilic polymers and initiator residues. The polymer latices are classified in various way. By origin, they are classified as natural latices, produced by metabolic processes occuring in the cells of certain plant species; synthetic latices, produced by emulsion polymerization of monomers; and artificial latices, produced by dispersing a polymer in a dispersing medium or by solvent exchange.

Preferred latices in connection with the invention are synthetic and artificial latices. These artificial latices are rather referred to as polymer dispersions. These polymers or oligomeric species could be dispersed in water either before their polymerization and/or crosslinking or afterwards. The colloidal stability of the dispersion can be improved by the addition of dispersion agents (surface-active compounds) or by ionic groups incorporated via the monomeric species or via modification. The dispersions of the polymers (or oligomers) can contain crosslinking agents, polymerization catalysts, or incorporated species which can give self-crosslinking of the polymer, to obtain sufficient mechanical strength.

A hydrophobic polymer according to the invention is a polymer which comprises at least one monomer with a reactive group. Examples of suitable reactive groups are alkoxysilane groups, oxazoline groups and activated carboxylic acids, e.g. carbodiimide derivatives and preferably epoxide groups and trialkoxysilane groups. Said reactive groups are contained in the side chain of the hydrophobic polymer. Alkoxysilane containing monomers can contain the following polymerizable groups: acrylate, methacrylate, acrylamide, methacrylamide, vinyl ether, styrene-derivatives.

The reactive group in the hydrophobic polymer can be introduced in the hydrophobic polymer by copolymerization of monomers comprising said reactive groups or can be introduced by chemical modification of said hydrophobic polymer.

Preferably said hydrophobic polymer is a copolymer containing at least a comonomer without a reactive group. Said hydrophobic polymer comprises a comonomer with a reactive group in a range of 1 to 50% by weight, more preferably in a range of 3 to 30 % by weight of the polymer.

Said hydrophobic copolymers are preferably polymers dispersed in water, prepared by chain copolymerization of monomers like styrene, styrene derivatives, acrylates, methacrylates, acrylamides, methacrylamides, or olefines, or prepared by step polymerization and forming polymers like polyurethanes, polyethers, polyamides, polyamic acids and polyether imides.

Hydrophobic copolymers for use in synthetic latices according to the present invention are, for example, polystyrene and styrenic copolymers such as styrene/butadiene/acrylic acid copolymers, polyacrylates such as polymethyl methacrylate and polybutyl acrylate, copolymers of butyl acrylate and methyl methacrylate, copolymers of butyl acrylate and styrene, copolymers of butadiene and methyl methacrylate.

Hydrophobic polymers for use in artificial latices according to the present invention are, for example polyurethanes such as the reaction product of a diisocyanate with a hydroxyl terminated polymer or oligomer (such as polyglycol or polyester) or reaction products of diisocyanates with amine-functional dialcohols (such as N-methyldiethanolamine, which can be quaternized e.g. using dimethylsulphate, methyliodide or 1,4-dibromobutane). These polymerizations are carried out in an organic solvent such as acetone, tetrahydrofurane, The polyurethanes soluble in polar organic solvents are mixed with water, and the organic solvent is eliminated from the aqueous-organic solutions to produce stable polyurethane latices (e.g. as described by D. Dieterich, Angew. Macromol. Chem., 76, 79 (1979), J. Dieterich et al., J. Oil Col. Chem. Assoc., 53, 636, (1970), V. S. Reddy, J. Dispers. Sci.Technol., 14, 417, (1993)). Stabilization of the polyurethane dispersions can also be achieved via anionic groups such as carboxylate, sulphonate, phosphonate. Addition of a dispersion agent (surface active compound) can give sufficient stabilization to the polyurethane latex. Diisocyanates which could be used to produce the polyurethanes could be aliphatic or aromatic, for example hexametylene 1,6-diisocyanate, isophorone diisocyanate, 1,6-diisocyanatotrimethylcyclohexane, diphenylmethane 4,4'-diisocyanate, naphthalene 1,5-diisocyanate.

In order to facilitate the evaluation of the obtained lithographic plate colored hydrophobic polymer synthetic or artificial latices can be used. For example, carbon black or dyes or pigments can be mixed with one of the above mentioned copolymers. Also polymer particles containing color structures in the repeating units, in particular colored polymer particles which have obtained their color by means of a chemical reaction based on oxidative coupling of a color coupling group in the polymer structure of the particles with an aromatic primary amino compound, as described in Japanese Kokai 59/30873 can be used as colored hydrophobic polymer latex.

The hydrophobic polymer synthetic or artificial latex particles have preferably a particle size between 0.01 and 1 $\mu$m, more preferably between 0.01 $\mu$m and 0.25 $\mu$m.

The latex can contain from 1 to 70% by weight of hydrophobic polymer, more preferably from 2 to 40% by weight of hydrophobic polymer, most preferably from 5 to 30% by weight of hydrophobic polymer.

The latex can be dispensed onto the lithographic base having a hydrophilic surface preferably by an ink jet printer.

A volatilization preventive agent is added to the latex according to the present invention, if necessary, to suppress evaporation of the liquid in the ink-jet nozzle and to prevent clogging due to precipitation of the dissolved or dispersed components.

A surfactant is preferably added to the the latex used according to the present invention to adjust the size of droplets of the latex dispersed by the ink jet nozzle, to adjust the surface tension of the latex so that images can be formed in high resolution. Said surfactant can be an anionic, a cationic, a non-ionic or an amphoteric compound.

Other components can be further added, if necessary, to the latex used according to the present invention. For example, heat polymerization inhibitors, disinfectants, anti-contamination agents and anti-fungal agents can be also added. Use of buffers and solubilizers is effective to improve the solubility or dispersibility of the polymer. Addition of defoaming agents and foam suppressing agents are also possible to suppress foaming of the latex in the ink-jet nozzle.

The image forming requires the following steps. On demand, microdots of the hydrophobic polymer latex are sprayed onto the lithographic base in a predetermined pattern as the plate passes through the printer or by a printhead shuttling over the plate. According to one embodiment of the invention, the microdots have a diameter of about 20 $\mu$m. In a following step heating may be required for the lithographic base sprayed with hydrophobic polymer latex. This can be done by irradiation, by convection or by contact with a hot surface e.g. in an oven, by flash exposure, by IR-heaters or by laser irradiation.

The image forming can also be carried out with the lithographic e already on the printing cylinder. In that case the heating of polymer can be effected by using a heated printing cylinder.

The printing plate of the present invention can also be used in printing process as a seamless sleeve printing plate. This indrical printing plate has such a diameter that it can be slided the print cylinder. More details on sleeves are given in "Gafisch Nieuws" ed. Keesing, 15, 1995, page 4 to 6.

The following examples illustrate the present invention without limiting it thereto. All parts and percentages are by weight unless otherwise specified.

EXAMPLE 1

Preparation of the latices

Seven latices were prepared all having 20% by weight in water of copolymer. Their composition is given in table 1.

TABLE 1

| Nr | Monomer 1 | % | Monomer 2 | % | Monomer 3 | % |
|---|---|---|---|---|---|---|
| 1 | Ethylene | 100 | — | — | — | — |
| 2 | Bu-Acrylate | 20 | Styrene | 80 | — | — |
| 3 | Bu-Acrylate | 20 | Styrene | 75 | HEMA | 5 |
| 4 | Bu-Acrylate | 20 | Styrene | 75 | GMA | 5 |
| 5 | Bu-Acrylate | 20 | Styrene | 75 | MOPTMS | 5 |
| 6 | Bu-Acrylate | 20 | Styrene | 70 | MOPTMS | 10 |
| 7 | Bu-Acrylate | 20 | Styrene | 70 | GMA | 10 |

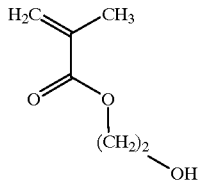

HEMA

TABLE 1-continued

| Nr | Monomer 1 | % | Monomer 2 | % | Monomer 3 | % |
|---|---|---|---|---|---|---|

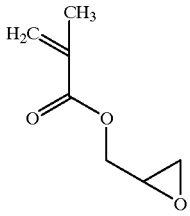

GMA

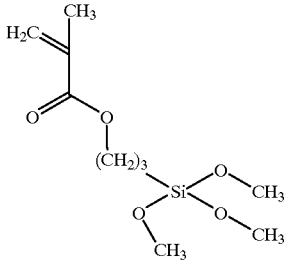

MOPTMS

These latices were imagewise jetted on an hydrophilic support, said support being anodized aluminum or a layer of hardened polyvinyl alcohol on polyethylene terephthalate. These supports were prepared as follows:

Preparation of the Anodized Aluminum Support

A 0.30 mm thick aluminum foil was degreased by immersing the foil in an aqueous solution containing 5 g/l of sodium hydroxide at 50° C. and rinsed with demineralized water. The foil was then electrochemically grained using an alternating current in an aqueous solution containing 4 g/l of hydrochloric acid, 4 g/l of hydroboric acid and 5 g/l of aluminum ions at a temperature of 35° C. and a current density of 1200 A/$m^2$ to form a surface topography with an average center-line roughness Ra of 0.5 $\mu$m.

After rinsing with demineralized water the aluminum foil was then etched with an aqueous solution containing 300 g/l of sulfuric acid at 60° C. for 180 seconds and rinsed with demineralized water at 25° C. for 30 seconds.

The foil was subsequently subjected to anodic oxidation in an aqueous solution containing 200 g/l of sulfuric acid at a temperature of 45° C., a voltage of about 10 V and a current density of 150 A/$m^2$ for about 300 seconds to form an anodic oxidation film of 3.00 g/$m^2$ of $Al_2O_3$, and then washed with demineralized water, posttreated with a solution containing polyvinylphosphonic acid and subsequently with a solution containing aluminum trichloride, rinsed with demineralized water at 20° C. during 120 seconds and dried.

Preparation of a Layer of Hardened Polyvinyl Alcohol on Polyethylene Terephthalate Preparation of the Solution for the Subbing Layer.

To a solution of 11.4 g of gelatine (viscosity: 19–21 mPas) in 940 ml of water was added 31.7 ml(11.4 g solid product) KIESELSOL 300 F. (tradename for 30% aqueous dispersion of colloidal silica—surface area of 300 $m^2$ per g). Anionic wetting agents (0.6 g) and biocides (1 g) were added.

Preparation of the Hydrophilic Support

To 440 g of a dispersion containing 21.5% $TiO_2$ (average particle size 0.3 to 0.5 $\mu$m) and 2.5% polyvinyl alcohol in deionized water were subsequently added, while stirring, 250 g of a 5% polyvinyl alcohol solution in water, 105 g of a hydrolyzed 22% tetramethyl orthosilicate emulsion in water and 22 g of a 10% solution of a wetting agent. To this mixture was then added 183 g of deionized water and the pH was adjusted to pH=4.

Preparation of the Hydrophilic Support

To a polyethylene terephthalate support, coated with a primer containing 170 mg/$m^2$ of a latex of copoly (vinylidenechloride/ methyl methacrylate/ icatonic acid) and 40 mg/$m^2$ of silica with a surface area of 100 $m^2$/g was applied the above described solution for the subbing layer at a solids coverage of 750 mg/$m^2$. On top of the subbing layer was coated the above mentioned hydrophilic layer to a wet coating thickness of 50 g/$m^2$, dried at 30° C. and subsequently hardened by subjecting it to a temperature of 60° C. for 1 week.

On one of those supports a sample was imaged with latex composition 1–7 and dried at room temperature. In some cases the printing plate is afterwards treated in an oven at 60° C. for 30 minutes and then cooled to room temperature. The printing plates were applied on a AB-Dick 360 printing press and printed with conventional ink (Van Son rubberbase) and a commercial fountain (2% Tame). The printing results are given in table 2.

TABLE 2

| Nr | Latex(table 1) | support | Heating temperature | Endurance |
|---|---|---|---|---|
| 1 | 1 | PTT | 22° C. | – |
| 2 | 1 | PTT | 60° C. | – |
| 3 | 2 | PTT | 22° C. | –– |
| 4 | 2 | PTT | 60° C. | 0 |
| 5 | 2 | ALU | 22° C. | –– |
| 6 | 2 | ALU | 60° C. | 0 |
| 7 | 3 | PTT | 22° C. | – |
| 8 | 3 | PTT | 60° C. | 0 |
| 9 | 3 | ALU | 22° C. | –– |
| 10 | 3 | ALU | 60° C. | – |
| 11 | 4 | ALU | 60° C. | ++ |
| 12 | 5 | PTT | 22° C. | ++ |
| 13 | 5 | ALU | 22° C. | ++ |
| 14 | 5 | ALU | 60° C. | ++ |
| 15 | 6 | PTT | 60° C. | ++ |
| 16 | 6 | ALU | 22° C. | ++ |
| 17 | 6 | ALU | 60° C. | ++ |
| 18 | 7 | ALU | 60° C. | ++ |

Support:Alu (anodized aluminum) or PTT (polyvinyl alcohol hardened layer: Polyvinyl alcohol-Titane dioxide- Tetramethyi orthosilicate)
Endurance
––very poor
–poor
0 moderate
+good
++very good.

It is seen from the results in table 2 that the latices with a hydrophobic polymer containing groups which can react with the hydrophilic surface of the lithographic base all give a printing plate with very good printing endurance, independent from the fact whether the support is anodized aluminum or a polyvinyl alcohol hardened layer and independent from the fact whether the printing plate is warmed in an oven or not.

What is claimed is:

1. A method for making a lithographic printing plate comprising dispensing in a predetermined pattern by ink jet printing onto a grained and anodized aluminum support having oxide and hydroxyl reactive groups, a latex of particles of a hydrophobic polymer having reactive groups capable of reacting with the reactive groups of said aluminum support and selected from the group consisting of epoxide, alkoxy silanes, reactive acrylamides, oxazoline groups and activated carboxylic acids.

2. A method for making a lithographic printing plate comprising dispensing in a predetermined pattern by ink jet printing onto a flexible support carrying a crosslinked hydrophilic layer having a crosslinked hydrophilic binder comprising reactive groups selected from the group consisting of epoxide, alkoxy silanes, reactive acrylamides, oxazoline groups and activated carboxylic acids, a latex of particles of a hydrophobic polymer having reactive groups capable of reacting with the reactive groups of said hydrophilic binder and selected independently from the group consisting of epoxide, alkoxy silanes, reactive acrylamides, oxazoline groups and activated carboxylic acids.

3. A method according to claim 1 or 2 wherein said hydrophobic polymer is a polymer dispersed in water, prepared by chain polymerization of a monomer selected from the group consisting of styrene, styrene derivatives, acrylates, methacrylates, acrylamides, methacrylamides, or olefines, or prepared by step polymerization and forming a polymer selected from the group consisting of polyurethanes, polyethers, polyamides, polyamic acids and polyether imides.

4. A method according to claim 1 or 2 wherein the reactive groups are introduced in the hydrophobic polymer by copolymerization of monomers comprising said reactive group or are introduced by chemical modification of the polymer.

5. A method according to claim 1 or 2 wherein said hydrophobic polymer comprises at least one comonomer without a reactive group.

6. A method according to claim 1 or 2 wherein said hydrophobic polymer comprises a comonomer with a reactive group in a range of 1 to 50% by weight of the polymer.

7. A method according to claim 1 or 2 wherein the hydrophobic polymer has a Tg below 150° C.

* * * * *

UNITED STATES PATENT AND TRADEMARK OFFICE

CERTIFICATE OF CORRECTION

PATENT NO. : 6,354,209 B1
DATED : March 12, 2002
INVENTOR(S) : Huub Van Aert et al.

It is certified that error appears in the above-identified patent and that said Letters Patent is hereby corrected as shown below:

Title page,
Item [60], insert the following:

-- Related U.S. Application Data
[60] Provisional application No. 60/101,035, filed on September 18, 1998. --.

Column 2,
Line 60, insert the paragraph as follows:
-- Said anodized aluminum support has as reactive groups oxide and hydroxyl groups. --

Column 4,
Line 44, insert the paragraph as follows:
-- a hydrophilic polymer for use in the present invention has preferably a Tg below 150ºC more preferably a Tg below 120ºC. --

Column 6,
Line 16, insert the paragraph as follows:
-- Optionally other components that enhance the latex quality can be added. --

Line 30, “lithographic e” should read -- lithographic base --.

Line 36, “indrical” should read -- cylindrical --.

Line 37, “slided the” should read -- slided on the --.

Column 7,
Line 58, “KIESELSOL 300 F.” should read -- KIESELSOL 300 F --.

UNITED STATES PATENT AND TRADEMARK OFFICE

CERTIFICATE OF CORRECTION

PATENT NO. : 6,354,209 B1
DATED : March 12, 2002
INVENTOR(S) : Huub Van Aert et al.

It is certified that error appears in the above-identified patent and that said Letters Patent is hereby corrected as shown below:

Column 8,
Line 42, "Tetramethyi" should read -- Tetramethyl --.

Signed and Sealed this

Seventeenth Day of September, 2002

*Attest:*

*Attesting Officer*

JAMES E. ROGAN
*Director of the United States Patent and Trademark Office*